US008610519B2

(12) United States Patent
Keimel et al.

(10) Patent No.: US 8,610,519 B2
(45) Date of Patent: Dec. 17, 2013

(54) MEMS MICROSWITCH HAVING A DUAL ACTUATOR AND SHARED GATE

(75) Inventors: Christopher Fred Keimel, Schenectady, NY (US); Xuefeng Wang, Schenectady, NY (US); Marco Francesco Aimi, Niskayuna, NY (US); Kanakasabapathi Subramanian, Clifton Park, NY (US)

(73) Assignee: General Electric Company, Niskayuna, NY (US)

( * ) Notice: Subject to any disclaimer, the term of this patent is extended or adjusted under 35 U.S.C. 154(b) by 271 days.

(21) Appl. No.: 11/961,737

(22) Filed: Dec. 20, 2007

(65) Prior Publication Data

US 2009/0159409 A1 Jun. 25, 2009

(51) Int. Cl.
*H01H 51/22* (2006.01)

(52) U.S. Cl.
USPC ..... 335/78; 200/181

(58) Field of Classification Search
USPC ..... 335/78; 200/181
See application file for complete search history.

(56) References Cited

U.S. PATENT DOCUMENTS

| | | | | |
|---|---|---|---|---|
| 6,037,719 | A | 3/2000 | Yap et al. | |
| 6,069,540 | A * | 5/2000 | Berenz et al. | 333/101 |
| 6,115,231 | A * | 9/2000 | Shirakawa | 361/233 |
| 6,307,169 | B1 * | 10/2001 | Sun et al. | 200/181 |
| 6,384,353 | B1 * | 5/2002 | Huang et al. | 200/181 |
| 6,440,767 | B1 * | 8/2002 | Loo et al. | 438/52 |
| 6,624,367 | B1 * | 9/2003 | Chen | 200/181 |
| 6,750,745 | B1 * | 6/2004 | Wei et al. | 335/78 |
| 6,812,814 | B2 * | 11/2004 | Ma et al. | 333/262 |
| 7,038,301 | B2 | 5/2006 | Seki et al. | |
| 7,242,273 | B2 * | 7/2007 | Isobe et al. | 335/78 |
| 7,420,447 | B2 * | 9/2008 | Ruan et al. | 335/78 |
| 7,629,194 | B1 * | 12/2009 | Schaffner et al. | 438/52 |
| 2004/0207498 | A1 * | 10/2004 | Hyman et al. | 335/78 |

FOREIGN PATENT DOCUMENTS

| | | | |
|---|---|---|---|
| JP | 2004200151 | A | 7/2004 |
| JP | 2005142982 | A | 6/2005 |

OTHER PUBLICATIONS

Unofficial English translation of Office Action from CN dated Aug. 1, 2013.

* cited by examiner

*Primary Examiner* — Bernard Rojas
(74) *Attorney, Agent, or Firm* — Scott J. Asmus

(57) ABSTRACT

In accordance with one aspect of the present invention, a MEMS switch is provided. The MEMS switch includes a substrate, a first and a second actuating element electrically coupled together, an anchor mechanically coupled to the substrate and supporting at least one of the first and second actuating elements, and a gate driver configured to actuate the first and second actuating elements.

17 Claims, 3 Drawing Sheets

MEMS MICROSWITCH HAVING A DUAL ACTUATOR AND SHARED GATE

BACKGROUND

Embodiments of the invention relate generally to a microelectromechanical system (MEMS) switch, and more specifically, a MEMS microswitch having a dual actuator and shared gate.

Microelectromechanical systems (MEMS) are electromechanical devices that generally range in size from a micrometer to a millimeter in a miniature sealed package. A MEMS device in the form of a microswitch has a movable actuator, sometimes referred to as a movable electrode, that is moved toward a stationary electrical contact by the influence of a gate driver (also referred to as a gate or substrate electrode) positioned on a substrate below the movable actuator. The movable actuator may be a flexible beam that bends under applied forces such as electrostatic attraction, magnetic attraction and repulsion, or thermally induced differential expansion, that closes a gap between a free end of the beam and the stationary contact. If a large enough differential voltage exists between the free end of the beam and the stationary electrical contact, a resulting electrostatic force can cause the beam to self-actuate without any gating signal being provided by a gate driver. In certain current switching applications, this self-actuation can result in catastrophic failure of the switch or downstream systems.

Thus, it is desirable to design a MEMS switch that can hold-off an increased amount of voltage while avoiding self-actuation.

BRIEF DESCRIPTION

In accordance with one aspect of the present invention, a MEMS switch is provided. The MEMS switch includes a substrate, a first and a second actuating element electrically coupled together, an anchor mechanically coupled to the substrate and supporting at least one of the first and second actuating elements, and a gate driver configured to actuate the first and second actuating elements.

In accordance with another aspect of the present invention, a MEMS switch array is provided. The MEMS switch array includes a first MEMS switch and a second MEMS switch electrically coupled to the first MEMS switch in a series or parallel arrangement. The first switch includes a substrate, a first and a second actuating element electrically coupled together, an anchor mechanically coupled to the substrate and supporting at least one of the first and second actuating elements, and a first gate driver configured to actuate the first and second actuating elements. The second MEMS switch includes a third and a fourth actuating element electrically coupled together, a second anchor mechanically coupled to the substrate and supporting at least one of the third and fourth actuating elements, and a second gate driver configured to actuate the third and fourth actuating elements independently of the first and second actuating elements.

In accordance with yet another aspect of the present invention, a second MEMS switch array is provided. The MEMS switch includes a substrate, a first actuating element and a second actuating element electrically coupled together, an anchor mechanically coupled to the substrate and supporting at least one of the first and second actuating elements, a gate driver configured to actuate the first and second actuating elements, and a switch cap disposed over the MEMS switch and forming a hermetic seal with the substrate.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

In accordance with embodiments of the invention, a MEMS switch having an increased voltage stand-off capability (also referred to as hold-off capability) is described. In the following detailed description, numerous specific details are set forth in order to provide a thorough understanding of various embodiments of the present invention. However, those skilled in the art will understand that embodiments of the present invention may be practiced without these specific details, that the present invention is not limited to the depicted embodiments, and that the present invention may be practiced in a variety of alternative embodiments. In other instances, well known methods, procedures, and components have not been described in detail.

Furthermore, various operations may be described as multiple discrete steps performed in a manner that is helpful for understanding embodiments of the present invention. However, the order of description should not be construed as to imply that these operations need be performed in the order they are presented, nor that they are even order dependent. Moreover, repeated usage of the phrase "in one embodiment" does not necessarily refer to the same embodiment, although it may. Lastly, the terms "comprising", "including", "having", and the like, as well as their inflected forms as used in the present application, are intended to be synonymous unless otherwise indicated.

The term MEMS generally refers to micron-scale structures that can integrate a multiplicity of functionally distinct elements such as mechanical elements, electromechanical elements, sensors, actuators, and electronics, on a common substrate through micro-fabrication technology. It is contemplated, however, that many techniques and structures presently available in MEMS devices will in just a few years be available via nanotechnology-based devices, for example, structures that may be smaller than 100 nanometers in size. Accordingly, even though example embodiments described throughout this document may refer to MEMS-based switching devices, it is submitted that the embodiments should be broadly construed and should not be limited to only micron-sized devices unless otherwise limited to such.

Figure 1:
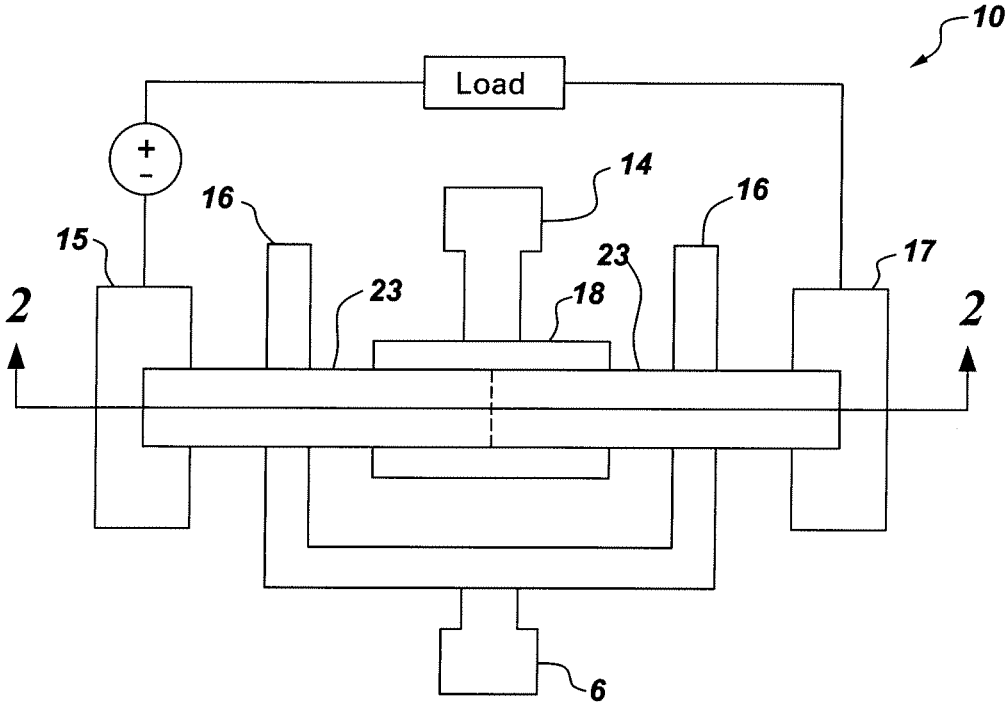
FIG. 1 is a schematic illustrating one embodiment of a MEMS switch having increased voltage standoff capabilities.
Figure 2:
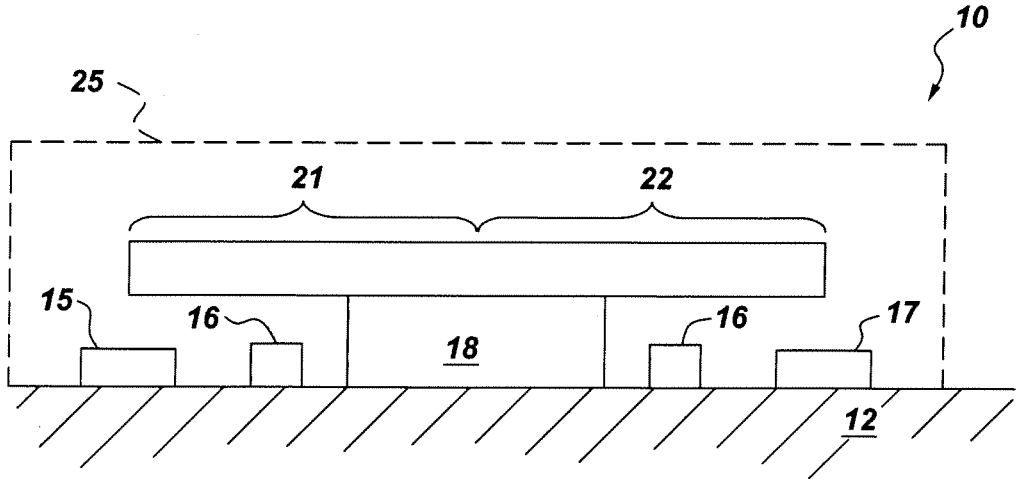
FIG. 2 is a cross-sectional view of the MEMS switch of FIG. 1.

FIG. 1 is a schematic illustrating one embodiment of a MEMS switch having increased voltage standoff capabilities. FIG. 2 is a cross-sectional view of the MEMS switch 10 of FIG. 1 taken across section line 2 as shown. In the illustrated embodiment, MEMS switch 10 is supported by an underlying substrate 12. The substrate 12 provides support to the MEMS switch and may represent a rigid substrate formed from silicon or germanium for example, or the substrate 12 may represent a flexible substrate such as that formed from a polyimide for example. Moreover, the substrate 12 may be conductive or may be insulating. In embodiments where the substrate 12 is conductive, an additional electrical isolation layer (not shown) may be included between the substrate 12 and the MEMS switch contacts, anchor and gate (described below) to avoid electrical shorting between such components.

The MEMS switch 10 includes a first contact 15 (sometimes referred to as a source or input contact), a second contact 17 (sometimes referred to as a drain or output contact), and a movable actuator 23. In one embodiment, the movable actuator 23 is conductive and may be formed from any conductive material or alloy. In one embodiment, the contacts (15, 17) may be electrically coupled together as part of a load circuit and the movable actuator 23 may function to pass electrical current from the first contact 15 to the second contact 17 upon actuation of the switch. As illustrated in FIG. 2, the movable actuator 23 may include a first actuating element 21 configured to make an electrical connection with the first contact 15 and a second actuating element 22 configured to make an electrical connection with the second contact 17. In one embodiment, the first and second actuating elements are electrically coupled to each other, however, they may nonetheless be independently actuated depending upon the attraction force applied to each actuating element. In one embodiment, the first and second actuating elements may be simultaneously attracted toward the substrate 12 during actuation (described further below). In one embodiment, the first and second actuating elements are integrally formed as opposite ends of actuating elements that share the same anchor region and are electrically conductive. In an alternative embodiment, the first and second actuating elements may be electrically coupled through additional internal or external electrical connections. By integrating the first and second actuating elements as part of the same movable actuator, external connections may be eliminated thereby reducing the overall inductance of the device.

As illustrated in FIG. 1 and FIG. 2, the movable actuator 23 (including the first actuating element 21 and the second actuating element 22) may be supported and mechanically coupled to the substrate 12 by one or more anchors 18. In one embodiment, the movable actuator 23 may also be electrically coupled to the anchor(s) 18. In an embodiment where a single anchor 18 is used to support both the first actuating element 21 and the second actuating element 22, it may be desirable for the anchor 18 to be sufficiently wide (in a direction extending between the first and second contacts) such that any strain or inherent stresses associated with one actuating element are not transferred or mechanically coupled to the second actuating element. Moreover, in an embodiment where a single anchor 18 is used to support both the first actuating element 21 and the second actuating element 22, the distance of the fixed material between the movable actuating elements may be greater then the combined length of the moveable elements.

In accordance with one aspect of the present invention, the MEMS switch 10 includes a common gate 16 controlled by a single gate driver 6 and configured to contemporaneously impart an attraction force upon both the first and second actuating elements 21 and 22. Such attraction force may be embodied as an electrostatic force, magnetic force, a piezo-resistive force or as a combination of forces. In an electrostatically actuated switch, the gate 16 may be electrically referenced to the switch reference 14, which in FIG. 1 and FIG. 2 is at the same electrical potential as the conduction path of the movable actuator 23. In a magnetically actuated switch, a gating signal, such as a voltage, is applied to change the magnetic state of a material to provide or eliminate a presence of a magnetic field which drives the moveable elements. Similarly, a gating signal such as a voltage can be applied to a piezoresistive material spanning the moveable elements to induce actuation. In the case of both magnetic and piezo-resistive actuation, the gating signal does not create an electrostatic attractive force between the moveable elements and therefore does not need to be referenced to the moveable elements.

In one embodiment, the gate driver 6 includes a power supply input (not shown) and a control logic input that provides a means for changing the actuation state of the MEMS switch. In one embodiment, the gating voltage is referenced to the moveable actuating elements 21 and 22 and the differential voltages between the two contacts and respective movable elements are substantially equal. In one embodiment, the MEMS switch 10 may include a resistive grading network (not shown) coupled between the contacts and the switch reference 14 to maintain the switch reference 14 at a potential that is less than the self-actuation voltage of the switch.

By sharing a common gating signal in the MEMS switch 10, a large actuation voltage that may otherwise surpass the actuation voltage for a conventional MEMS switch, would be shared between the first actuating element and the second actuating element. For example, in the MEMS switch 10 of FIG. 1 and FIG. 2, if a voltage of 200 v was placed across the first contact 15 and the second contact 17, and the switch reference 17 was graded to 100 v, the voltage between the first contact 15 and the first actuating element 21 would be approximately 100 v while the voltage between the second contact 17 and the second actuating element 22 would also be approximately 100 v.

In FIG. 2, the MEMS switch 10 further includes a cap 25 that forms a hermetic seal with the substrate 12 around the components of MEMS switch 10 including both actuating elements 21 and 22. Typically, many MEMS switches are formed on a single substrate. These switches are then capped and singulated or diced. In one embodiment, the first and second actuating element and the common gate 16 of MEMS switch 10 are formed and capped on a single die. By including the first and second actuating elements within a single cap, it is possible to increase the standoff voltage of the MEMS switch without substantially increasing the switch footprint. For example, the standoff voltage of the switch effectively can be doubled, while the overall switch footprint is only increased slightly more than that of a single switch.

Figure 3:
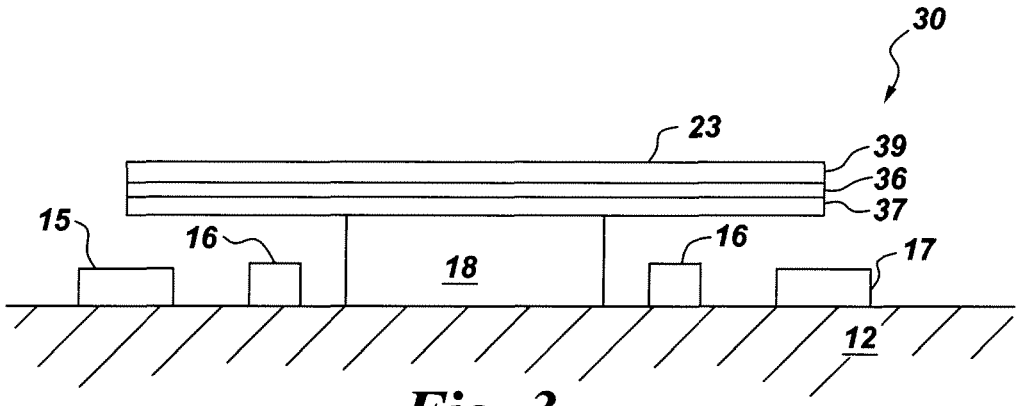
FIG. 3 is a schematic of a MEMS switch having an electrical biasing component in accordance with one embodiment of the invention.

FIG. 3 is a schematic of a MEMS switch 30 in accordance with another embodiment of the invention. In the illustrated embodiment, MEMS switch 30 is substantially similar to MEMS switch 10, however, the movable actuator MEMS switch 30 further includes an electrical biasing component 39 isolated from the conduction path 37 of the movable actuator 23 by an isolation region 36. The electrical biasing component 39 may represent a conductive layer or trace formed as part of the movable actuator in a MEMS photolithographic fabrication process. In another embodiment, the electrical biasing component 39 may represent a piezo-resistive material configured to impart and mechanical force on the movable actuator 23. In one embodiment, the electrical biasing component 39 may be electrically referenced to the gate 16. In such an embodiment, the actuation voltage of the MEMS switch 30 would be independent of the voltage across the conduction path of the movable electrode (e.g., across the first and second contacts) and therefore can be increased beyond the normal standoff capabilities of the switch. Although not shown, MEMS switch 30 may also be capped as was described with respect to MEMS switch 10.

Figure 4:
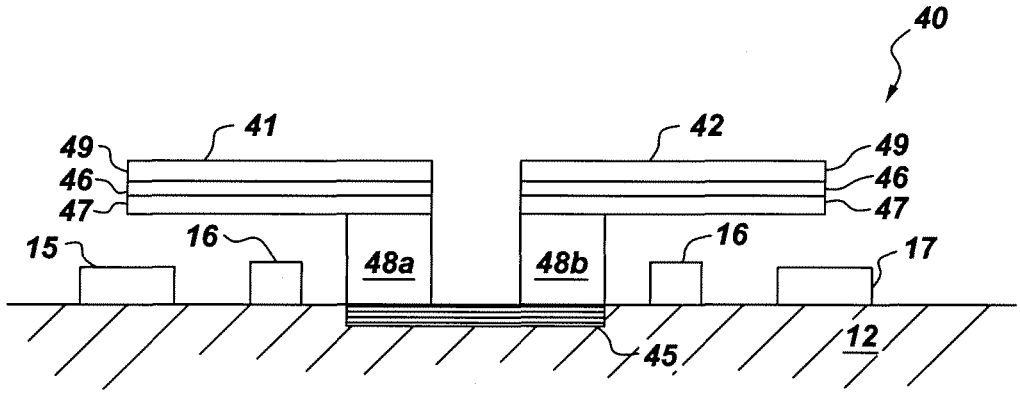
FIG. 4 is a schematic illustrating one embodiment of a MEMS switch in which a first actuating element and a second actuating element are physically separated.

FIG. 4 is a schematic illustrating one embodiment of a MEMS switch in which a first actuating element and a second actuating element are physically separated. As shown, MEMS switch 40 may include a first actuating element 41 supported by a first anchor 48*a* and a second actuating element 42 supported by a second anchor 48*b*. In an alternative embodiment, the first actuating element 41 and the second actuating element 42 may be supported by a single anchor while maintaining separation between the actuating elements. In the illustrated embodiment, the first and the second actuating elements may each include electrical biasing components 49 isolated from the conduction path 47 of the respective actuating element by an isolation region 46. As with MEMS switch 30, the electrical biasing component 49 may represent a conductive layer or trace formed as part of the actuating element in a MEMS photolithographic fabrication process or a piezo-resistive material configured to impart and mechanical force on a respective actuating element. In one embodiment, the conduction paths 47 of each the actuating elements 41 and 42 may be electrically coupled by electrical connection 45. Although not shown, MEMS switch 40 may also be capped as was described with respect to MEMS switches 10 and 30.

Figure 5:
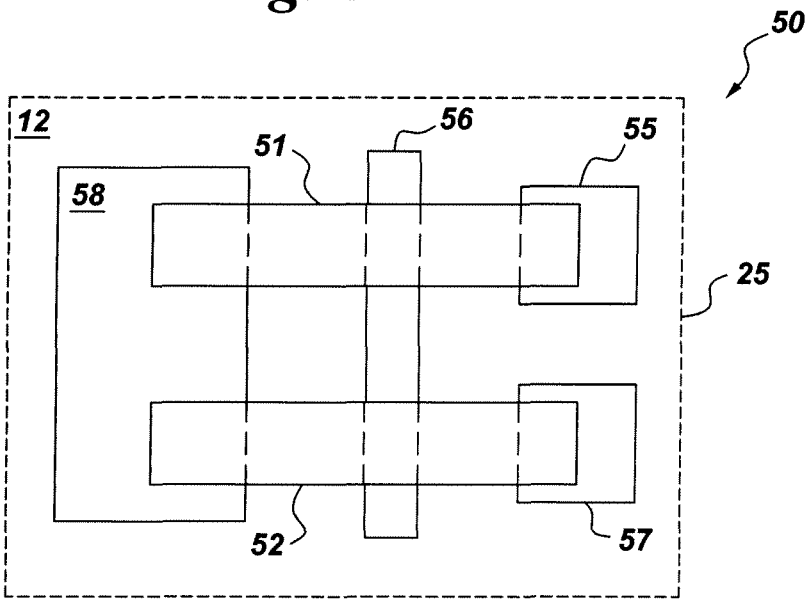
FIG. 5 is a schematic illustrating an alternative embodiment of a MEMS switch in which the first actuating element and the second actuating element are physically separated.

FIG. 5 is a schematic illustrating an alternative embodiment of a MEMS switch in which the first actuating element and the second actuating element are physically separated. As shown, MEMS switch 50 may include a first actuating element 51 and a second actuating element 52 supported by a single anchor 58. As with the previously described MEMS switches, the first actuating element 51 and the second actuating element 52 may be commonly actuated to respectively make electrical contact with contacts 55 and 57 based upon an attraction force generated by a signal from the gate 56. As with MEMS switches 10, 30 and 40, MEMS switch 50 may further include a cap 25 which forms a hermetic seal with the substrate 12 over the various MEMS components.

Figure 6:
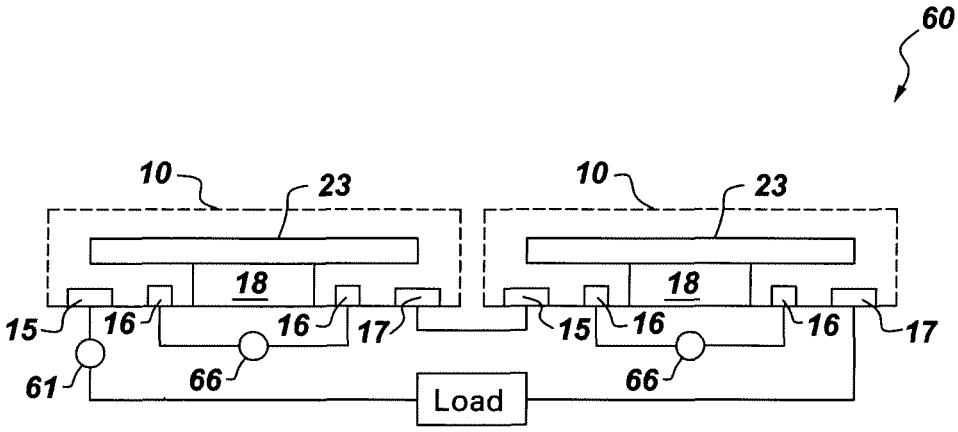
FIG. 6 is a schematic illustrating an array of two or more MEMS switches according to one embodiment of the invention.

FIG. 6 is a schematic illustrating an array 60 of two or more MEMS switches according to one embodiment of the invention. In the illustrated embodiment, each MEMS switch 10 includes a movable actuator 23 including a first and a second actuating element (not shown) that is actuated based upon the actuating state of common gate 16. In one embodiment, each MEMS switch 10 in the MEMS switch array 60 is controlled by a separate gate driver 66. In turn, each gate driver 66 controls the actuation state of the common gate 16 shared between the first and second actuating elements of a given MEMS switch 10. In the illustrated embodiment, the array 60 of two MEMS switches 10 are shown electrically coupled in series with the output contact 17 of a first MEMS switch 10 being connected to the input contact 15 of an adjoining MEMS switch 10. However, these or additional MEMS switches may also be electrically coupled in parallel or series-parallel combinations depending upon the end-use application. In one embodiment, the MEMS array 60 may be employed as part of an electrical interruption device suitable for arcless interruption of direct current from a current source 61. In order to achieve a desirable voltage rating for a particular application such as arcless current interruption, the MEMS switches 10 in the MEMS switch array 60 may be operatively coupled in series, parallel and series/parallel to achieve the desired voltage and current dividing effects.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. An apparatus comprising:

a substrate;

a first and a second actuating element electrically coupled together in series, wherein the first and second actuating elements are configured to be independently actuated and continuously integrally formed as opposite ends of a moveable actuator and wherein the first and second actuating elements are further configured to be simultaneously attracted towards the substrate;

an anchor mechanically coupled to the substrate and supporting at least one of the first and second actuating elements, wherein the first and second actuating elements are coupled to the anchor; and a gate driver configured to provide a common gating signal to actuate the first and second actuating elements.

2. The apparatus of claim 1, wherein at least one of the first and second actuating elements is conductive.

3. The apparatus of claim 1, further comprising a first contact and a second contact configured such that the first actuating element is electrically coupled to the first contact and the second actuating element is electrically coupled to the second contact when actuated by the gate driver.

4. The apparatus of claim 1, further comprising a first contact and a second contact configured such that a differential voltage between the second actuating element and the second contact is approximately equal to a differential voltage between the first actuating element and the first contact.

5. The apparatus of claim 1, further comprising a switch cap disposed over the first and second actuating elements.

6. The apparatus of claim 1, wherein the gate driver is electrically referenced to the first and second actuating elements.

7. The apparatus of claim 1, wherein the first and second actuating elements comprise conductive actuating elements.

8. The apparatus of claim 7, wherein the first and second actuating elements further comprise an electrical biasing component electrically isolated from the actuating elements.

9. The apparatus of claim 8, wherein the electrical biasing component is electrically referenced to the gate driver.

10. The apparatus of claim 8, wherein the electrical biasing component comprises a piezoresistive element.

11. The apparatus of claim 1, wherein the first and second actuating elements are electrostatically actuatable.

12. The apparatus of claim 1, wherein the first and second actuating elements comprise a magnetic material.

13. The apparatus of claim 1, wherein the gate driver is configured to concurrently actuate the first and second actuating elements.

14. The apparatus of claim 1, wherein the first and second actuating elements extend from the anchor in a direction parallel to a surface of the substrate.

15. An apparatus comprising:

a first MEMS switch comprising a substrate, a first and a second actuating element electrically coupled together in series, wherein the first and second actuating elements are configured to be independently actuated and continuously integrally formed as opposite ends of a moveable actuator and wherein the first and second actuating elements are further configured to be simultaneously attracted towards the substrate, an anchor mechanically coupled to the substrate and supporting at least one of the first and second actuating elements, wherein the first and second actuating elements are coupled to the anchor; and a first gate driver configured to provide a common gating signal to actuate the first and second actuating elements; and a second MEMS switch electrically coupled to the first MEMS switch in a series or parallel arrangement, the second MEMS switch comprising a third and a fourth actuating element electrically coupled together in series, a second anchor mechanically coupled to the substrate and supporting at least one of the third and fourth actuating elements, wherein the third and fourth actuating elements are coupled to the second anchor; and a second gate driver configured to actuate the third and fourth actuating elements independently of the first and second actuating elements.

16. The apparatus of claim 15, further comprising a second substrate, wherein the second MEMS switch is formed on the second substrate.

17. An apparatus comprising:

a substrate;

a first actuating element and a second actuating element electrically coupled together in series, wherein the first and second actuating elements are configured to be independently actuated and continuously integrally formed as opposite ends of a moveable actuator and wherein the first and second actuating elements are further configured to be simultaneously attracted towards the substrate;

an anchor mechanically coupled to the substrate and supporting at least one of the first and second actuating elements, wherein the first and second actuating elements are coupled to the anchor;

a gate driver configured to provide a common gating signal to actuate the first and second actuating elements; and a switch cap disposed over the MEMS switch and forming a hermetic seal with the substrate.

* * * * *